United States Patent [19]

Colli

[11] Patent Number: 4,871,072

[45] Date of Patent: Oct. 3, 1989

[54] METHOD AND DEVICE FOR TUBE SELECTION

[75] Inventor: Luigi Colli, Pordenone, Italy

[73] Assignee: Savio, S.p.A., Pordenone, Italy

[21] Appl. No.: 206,586

[22] Filed: Jun. 14, 1988

[30] Foreign Application Priority Data

Jun. 30, 1987 [IT] Italy ..... 21108 A/87

[51] Int. Cl.[4] ..... B07C 9/00

[52] U.S. Cl. ..... 209/656; 209/700; 209/927

[58] Field of Search ..... 209/615, 651, 656, 700, 209/927; 242/35.5

[56] References Cited

U.S. PATENT DOCUMENTS

| | | | |
|---|---|---|---|
| 1,227,118 | 5/1917 | Colman | 209/927 X |
| 2,459,309 | 1/1949 | Cotchett | 209/927 X |
| 2,615,566 | 10/1952 | Ball et al. | 209/927 X |
| 4,295,569 | 10/1981 | Nieder | 209/700 |
| 4,750,622 | 6/1988 | Kupper | 209/927 X |

FOREIGN PATENT DOCUMENTS

| | | | |
|---|---|---|---|
| 2149573 | 4/1973 | Fed. Rep. of Germany | 209/927 |

*Primary Examiner*—Donald T. Hajec

*Attorney, Agent, or Firm*—Hedman, Gibson, Costigan & Hoare

[57] ABSTRACT

This invention relates to a method for selecting or sorting tubes for textile machines. Specifically, this method separates tubes which contain yarn residue from those that do not and discharges said residue containing tubes into a special container provided for that purpose. More specifically, the method provides automatic control in the transfer region between a spinning machine and a winding machine in the textile industry.

5 Claims, 2 Drawing Sheets

Fig.2
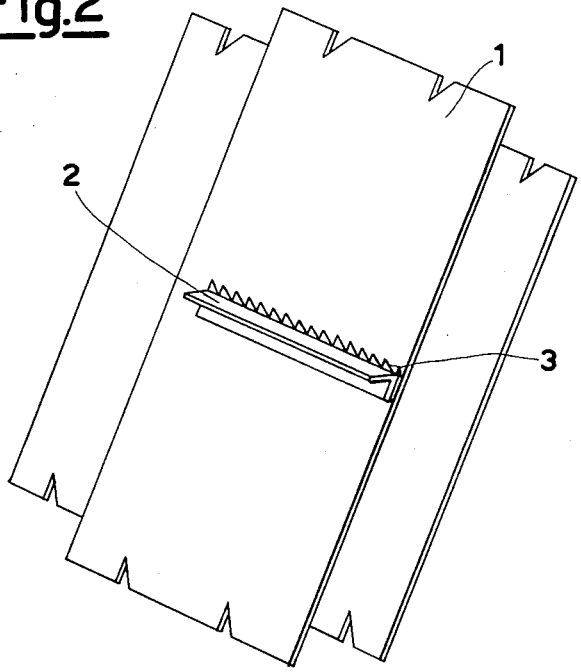
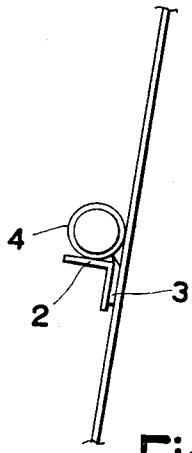
Fig.3
Fig.1A
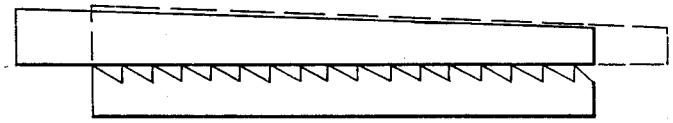
Fig.1B
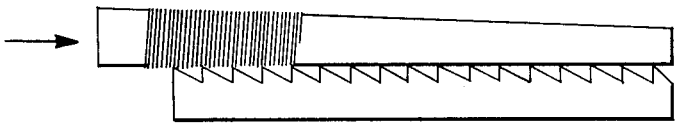

METHOD AND DEVICE FOR TUBE SELECTION

The ever increasing automation requirements in spinning, winding and similar processes in the textile industry have produced the need for developing specific automatic control of the various operations which arise when a spinning machine is coupled to a winding machine. Specifically, this involves developing automatic methods for distributing over the winding machine the packages which arrive from the spinning machine, and for handling the empty tubes from the winding machine which have to be returned to the spinning machine. Said tubes from the winding machine can contain yarn residues.

Said residues can themselves comprise a very variable number of filaments and be of very variable thickness and consistency. The problem therefore arises of identifying those tubes containing yarn residues and of discharging said residue-containing tubes into a special container provided for the purpose. Manual sorting of tubes with or without residues is known. This requires the continuous presence of one or more operators for separating the residue-containing tubes from those without residues, these being placed on the feed line to the spinning machine. Various apparatuses are also known for automating certain stages of this selection operation. Such apparatuses use sensors for sensing the presence of yarn on the tube. The effectiveness of such apparatuses is only partial. Moreover, known apparatuses are of particularly complicated construction, are bulky and are therefore costly.

An object of the present invention is to obviate the drawbacks of the known methods by introducing tube selection methods which are based on new concepts never before tried. The inventive concept on which the present invention is based is that all operations are controlled passively, the control being effected on the basis of passive operation of each member as the tube conveyor belt moves along.

In this respect, the method is implemented by a device formed form a conveyor belt comprising bars of suitable shape for supporting tubes which have been withdrawn from an accumulation region by feed means and for conveying them along the path taken by the belt.

The bars comprise on their interior a rigid strip of steel or other material which is toothed with fine toothing inclined by a few degrees. The fine toothing has a substantially triangular shape and is provided on a toothed element fixed between the conveyor belt and the supporting bars.

The belt moves upwards with an inclination sufficient to retain the tube on the belt. A spring-loaded lever is positioned laterally on one side of the belt and tends to displace the tubes as they reach its zone of action.

It a tube is completely free of yarn, it is made to slide along the teeth of the bar but without causing the lever to move, whereas it it is not, the yarn remains engaged in the teeth of the rigid steel strip fixed to the bar, in which case the tube moves the lever in the sense of spring-loading it.

A cam element rigid with the belt structure extracts the tube with residual yarn during its normal conveying, by raising it from the plane of the conveyor belt and causing it to slide into a collection box provided for this purpose.

Those tubes without residual yarn are unable to displace the lever and are therefore moved into a new position relative to the belt, so that they pass without interference by the lifting cam element and are able to proceed along their path until they are deposited on a further conveyor belt which conveys them to the spinning unit, which then arranges the tubes in the required manner for subsequent working.

A preferred embodiment of the present invention is described hereinafter by way of example with reference to the accompanying drawings, in which:

FIG. 1A is a diagrammatic illustration of the comb-type selector element, on the projections of which a tube free of yarn lies and slides;

FIG. 1B is a diagrammatic illustration of the comb-type selector element on which a tube with residual yarn lies and is engaged;

FIG. 2 is a diagrammatic front view of a portion of the conveyor belt provided with a tube support bar rigidly associated with the toothed selected disposed between the belt and said bar;

FIG. 3 is a diagrammatic side view of the front belt portion of FIG. 2 comprising the bar, and with the selector element adhering to a tube present on said bar;

In the figures, identical parts or parts of identical or equivalent operation are indicated by the same reference numerals.

Figure 4:
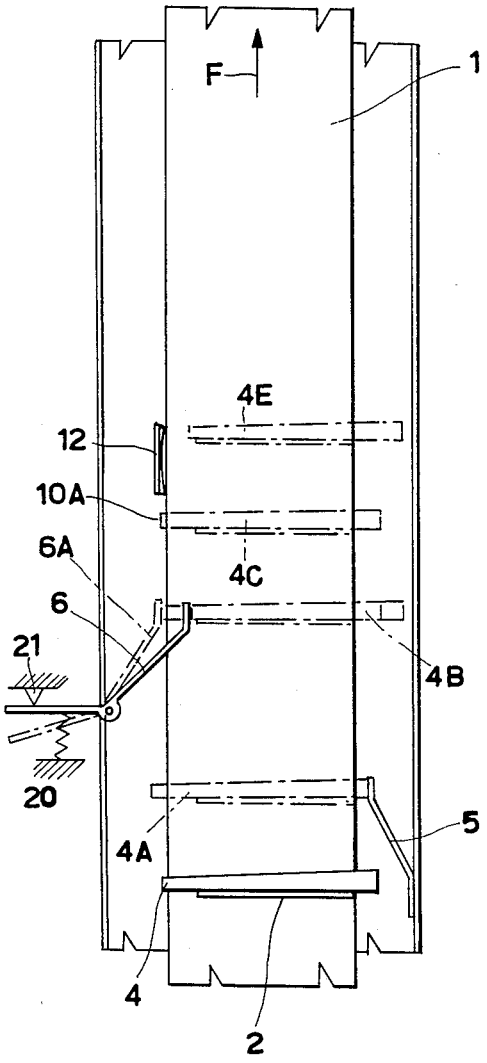
FIG. 4 is a diagrammatic illustration of that portion of the conveyor belt in correspondence with those elements which effect the positioning, sorting and possible discharge from the belt of the moving tubes.

In these: 1 is a conveyor belt provided with bars for conveying tubes withdrawn from an accumulation region; 2 is a longitudinal bar connected rigidly to the conveyor belt 1; 4 is a tube supported by the bar 2 and driven by the belt 1 along the direction indicated by the arrow F; 4A, 4B, 4C, 4D and 4E indicate the progressive positions which the tube 4 assumes in correspondence with the elements which effect its positioning, sorting and possible discharge from the belt 1 to feed it into a collection box 13; 3 is the comb-type selector element with fine teeth which is rigidly connected to the support bar 2 and to the conveyor belt 1; 5 is a lateral blade shaped and positioned in such a manner as to cause the tube 4, withdrawn from the underlying accumulation region, to assume a precise axial position on its bar support 2; 6 is a lever positioned laterally to the belt 1 and yieldable by rotating about a pivot against the elastic action of a spring 20. The teeth of the comb-type element have a major sloping flank fo the side of the lever 6. Said lever 6 cooperates with the comb-type element 3 to sort the tubes 4 driven by the belt 1, by causing them to assume one or another axial position on the support bars 2; 6A is the position which the lever 6 assumes when residual yarn is present on the tube 4; 10A represents the position of the end of the tube 4 when residual yarn is not present thereon. Said position is such as to interfere with the profile of the cam 12; 12 is a fixed cam which is positioned laterally to the conveyor belt 1 and by means of its profile causes the tubes with residual yarn to rise from their support 2 and to fall into and accumulate in the box provided for tubes 4 with residual yarn; 21 is a locator for the lever 6 when under the elastic action of the spring 20; 20 is a coil spring or similar elastic element which tends to keep the lever 6 adhering against the positioner 21. The operation is as follows.

The tube 4 withdrawn from the accumulation region is positioned and supported on the longitudinal bar 2 during its movement, and is conveyed by the conveyor belt 1 in the direction of the arrow F.

Figure 5:
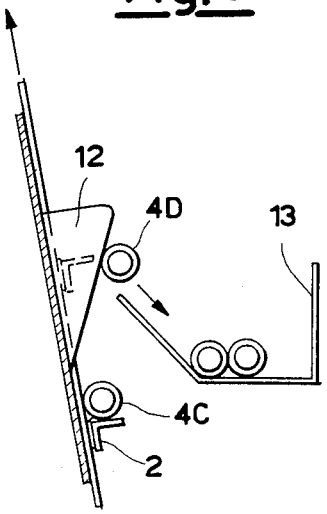
FIG. 5 is a diagrammatic side view of part of the belt portion of FIG. 4 in correspondence with the cam element which discharges those tubes with residual yarn from said belt and feeds them into a collection box provided for the purpose.

The lateral blade or cam 5 or similar element urges the tube 4 towards a substantially central region of the longitudinal bar 2 until it has positioned it at 4A as clearly shown in FIG. 4. On continuing its travel, the tube 4 interferes with the lever 6 which, urged elastically by the spring 20, tends to move it axially in the opposite direction to its previous axial movement. If the tube 4 contains residual yarn, it either does not move or moves only to a minimal extent, as the fine toothing of the selector element 3 digs into said residue so locking the tube axially on the longitudinal support bar 2. In this case the lateral lever 6, which is prevented from remaining in its rest position determined by its abutment against the positioner 21, yields by compressing the spring 20 and moves into the position 6A as shown in FIG. 4. As the tube 4 has not been displaced axially on the bar 2 by the lateral lever 6, on continuing its upward translation in the direction F it reaches the position 4C, with its end in the position 10A (see FIG. 4). On proceeding upwards from this latter position the tube interferes with the fixed cam 12 which causes it to rise from its support bar and move into the position 4D (see FIG. 5) from which it falls by gravity into the collection box 13.

If the tube 4 has not residual yarn, during its upward movement it interferes with the lateral lever 6 and is displaced laterally, sliding on the support 2 and on the upper profile of the selector teeth 3, until it becomes positioned axially in the position 4B (see FIG. 4). In this case the tube 4 proceeds upwards along a path different from the previously described path when yarn is present, and does not interfere with the fixed cam element 12. The tube 4 therefore proceeds along its path towards the spinning machine.

A preferred embodiment of the invention has been described heretofore, but modifications can be made thereto. The shape and dimensions of the support bars can be changed; the fine-toothed selector element can be of a non-metallic material suitable for the purpose; the bar, comb-type selector element and conveyor belt can be positioned relative to each other in a different manner, without leaving the scope of the present invention as claimed hereinafter.

I claim:

1. A method for separating tubes containing residual wound yarn for textile machines from a conveyor for conveying tubes with and without residual yarn comprising:

(a) positioning an individual tube by a lateral positioning means in a substantially central region of a supporting bar means connected to the conveyor, as the conveyor and supporting bar means moves upwardly;

(b) providing said supporting bar means with a toothed element for separating tubes with residual yarn from those which do not have residual yarn;

(c) sensing the presence of residual yarn on a tube by an elastically yieldable lateral lever means cooperating with said toothed element so as to maintain a tube with residual yarn in position on the supporting bar and axially displacing a tube without residual yarn along the length of the supporting bar;

(d) discharging the tube having the residual yarn by raising and removing it from said supporting bar means by means of a fixed lateral cam which only contacts and moves the tube with residual yarn from the support bar; and (e) accumulating the tubes with residual yarn in a collection box after removing them from said supporting bar means.

2. A device for separating tubes containing residual yarn for textile machines from a conveyor conveying tubes with and without residual yarn, comprising:

a) a plurality of supporting bar means transversely connected to the conveyor which each include a toothed element; centrally position the tubes on said supporting bar means;

(c) an elastically yieldable lateral lever which cooperates with each said toothed element to maintain a tube with residual yarn in position on the supporting bar means and axially displacing a tube without residual yarn along the length of the supporting bar means;

(d) a fixed lateral cam connected to the device, on one side of the conveyor, for displacing the end of the tube with residual yarn from the support bar means and discharging it from said supporting bar means; and (e) a collection box for receiving said discharged tubes by said cam from said supporting bar means.

3. The device of claim 2, wherein said each toothed element is fixed between the conveyor and said supporting bar means.

4. The device of claim 3, wherein said toothed element includes toothing with a substantially triangular shape.

5. The device of claim 4, wherein the teeth of said toothed element have a major sloping flank at the side of said lever.

* * * * *

UNITED STATES PATENT AND TRADEMARK OFFICE

CERTIFICATE OF CORRECTION

PATENT NO. : 4,871,072

DATED : October 3, 1989

INVENTOR(S) : Luigi Colli

It is certified that error appears in the above-identified patent and that said Letters Patent is hereby corrected as shown below:

Column 4, lines 30 and 31 delete "centrally position the tubes on said supporting bar means;"

Column 4, after line 30, add:
b) a lateral positioning means to substantially centrally position the tubes on said supporting bar means;

Signed and Sealed this

Nineteenth Day of February, 199

*Attest:*

HARRY F. MANBECK, JR.

*Attesting Officer*

*Commissioner of Patents and Trademarks*